US007824147B2

(12) United States Patent
Morris et al.

(10) Patent No.: US 7,824,147 B2
(45) Date of Patent: Nov. 2, 2010

(54) AIRFOIL PROGNOSIS FOR TURBINE ENGINES

(75) Inventors: Robert J. Morris, Portland, CT (US); Jerrol W. Littles, S. Glastonbury, CT (US); Sharayu Tulpule, Farmington, CT (US)

(73) Assignee: United Technologies Corporation, Hartford, CT (US)

( * ) Notice: Subject to any disclaimer, the term of this patent is extended or adjusted under 35 U.S.C. 154(b) by 489 days.

(21) Appl. No.: 11/435,171

(22) Filed: May 16, 2006

(65) Prior Publication Data

US 2007/0271023 A1 Nov. 22, 2007

(51) Int. Cl.
*F01B 25/26* (2006.01)

(52) U.S. Cl. ..... 415/1; 415/118; 415/61

(58) Field of Classification Search ..... 415/1, 415/17, 118, 9, 14; 701/99, 100, 101; 416/2, 416/61; 73/787; 702/81

See application file for complete search history.

(56) References Cited

U.S. PATENT DOCUMENTS 4,573,358 A * 3/1986 Luongo ..... 73/660
4,804,905 A * 2/1989 Ding et al. ..... 324/662
4,887,468 A * 12/1989 McKendree et al. ..... 73/660
4,896,537 A * 1/1990 Osborne ..... 73/660
4,914,953 A * 4/1990 Viscovich ..... 73/660
4,922,757 A * 5/1990 Rozelle et al. ..... 73/660
5,097,711 A * 3/1992 Rozelle et al. ..... 73/660
5,148,711 A * 9/1992 Twerdochlib et al. ..... 73/660
5,411,364 A * 5/1995 Aberg et al. ..... 415/9
5,440,300 A * 8/1995 Spillman, Jr. ..... 340/10.34
5,761,956 A * 6/1998 Beeson et al. ..... 73/660
5,900,555 A * 5/1999 Westphal et al. ..... 73/766
6,094,989 A * 8/2000 Twerdochlib ..... 73/659
6,761,528 B2 * 7/2004 Woditschka ..... 415/1
6,838,157 B2 * 1/2005 Subramanian ..... 428/173
7,034,711 B2 * 4/2006 Sakatani et al. ..... 340/686.1
2004/0037693 A1 * 2/2004 Stabley et al. ..... 415/1
2005/0129498 A1 * 6/2005 Brooks ..... 415/1
2005/0261820 A1 * 11/2005 Feeney et al. ..... 701/100
2006/0056959 A1 * 3/2006 Sabol et al. ..... 415/118
2006/0070435 A1 * 4/2006 LeMieux et al. ..... 73/168
2007/0139193 A1 * 6/2007 Arik et al. ..... 340/539.26
2007/0258807 A1 * 11/2007 Brummel ..... 415/118

* cited by examiner

*Primary Examiner*—Edward Look
*Assistant Examiner*—Aaron R Eastman
(74) *Attorney, Agent, or Firm*—Carlson, Gaskey & Olds

(57) ABSTRACT

A method and control for predicting the remaining useful life of an airfoil for a gas turbine engine includes the steps of monitoring conditions of the blade such as flutter, leaning, etc. A measured amount of deflection of the airfoil is compared to tabulated data to predict an expected crack length which is likely causing the deflection, etc. Once a predicted crack length has been identified, the amount of accumulated damage to the airfoil at the crack is monitored and stored. The amount of useful life for the blade can be predicted by compiling the accumulated damage over time. The useful life remaining can be displayed such that flight plans or maintenance schedules for the aircraft can be modified as appropriate.

8 Claims, 8 Drawing Sheets

AIRFOIL PROGNOSIS FOR TURBINE ENGINES

BACKGROUND OF THE INVENTION

This application relates to a system wherein movement, vibration, leaning or flutter of an airfoil in a turbine engine is monitored, and anomalies in the monitored condition are utilized to predict length of any crack that may be found in the airfoil. Once the crack length is determined, a "remaining life" is calculated given expected engine operating conditions. This expected life is to be utilized to plan flight schedules or missions and maintenance.

Gas turbine engines are provided with a number of functional sections, including a fan section, a compressor section, a combustion section, and a turbine section. Air and fuel are combusted in the combustion section. The products of the combustion move downstream, and pass over a series of turbine rotors, driving the rotors to create power. The turbine, in turn, drives rotors associated with the fan section and the compressor section.

The rotors associated with each of the above-mentioned sections (other than the combustion section) include removable blades. These blades have an airfoil shape, and are operable to move air (fan rotors), compress air (compressor rotors), and to be driven by the products of combustion (turbine rotors).

Cracks may form in airfoils, such as the blades. These cracks can result in a failure to the airfoil component over time. To date, no system has been able to successfully predict, detect and monitor the existence, and growth of a crack in an airfoil, which may lead toward failure, and predict the remaining life of an airfoil.

SUMMARY OF THE INVENTION

In the disclosed embodiment of this invention, movement of the blades in a rotor associated with a turbine engine is monitored. Vibration, flutter, leaning, etc. of each of the blades is monitored. As an example, if a leading edge of a blade reaches a position where a sensor can sense it earlier (or later) than it was expected, an indication can be made that the blade is vibrating, leaning or fluttering.

The present invention has identified certain conditions that are expected in the event that a crack has occurred in an airfoil. Thus, the condition as sensed is compared to stored information to detect a crack and predict its length when anomalies are found in the operation of the airfoil. Once a crack of a certain length has been detected, other stored information can be accessed which will predict remaining useful life of the particular airfoil under various system conditions. At this point, the remaining life can be utilized such as for flight scheduling, or to schedule maintenance.

As one example, if two aircrafts have engines wherein one of the engines has a blade with a remaining life that is relatively short compared to the other, the aircraft with the blade approaching the end of its useful life may be scheduled for less stressful operation. As for example, in a military application, the jet aircraft with the longer-predicted blade life can be utilized for more stressful missions such as air to ground missions, while the aircraft having a blade closer to the end of its useful life may be scheduled for less stressful operations such as air coverage, at which it is likely to be at a relatively stationary speed loitering.

These and other features of the present invention can be best understood from the following specifications and drawings, the following of which is a brief description.

DETAILED DESCRIPTION OF THE PREFERRED EMBODIMENT

Figure 1:
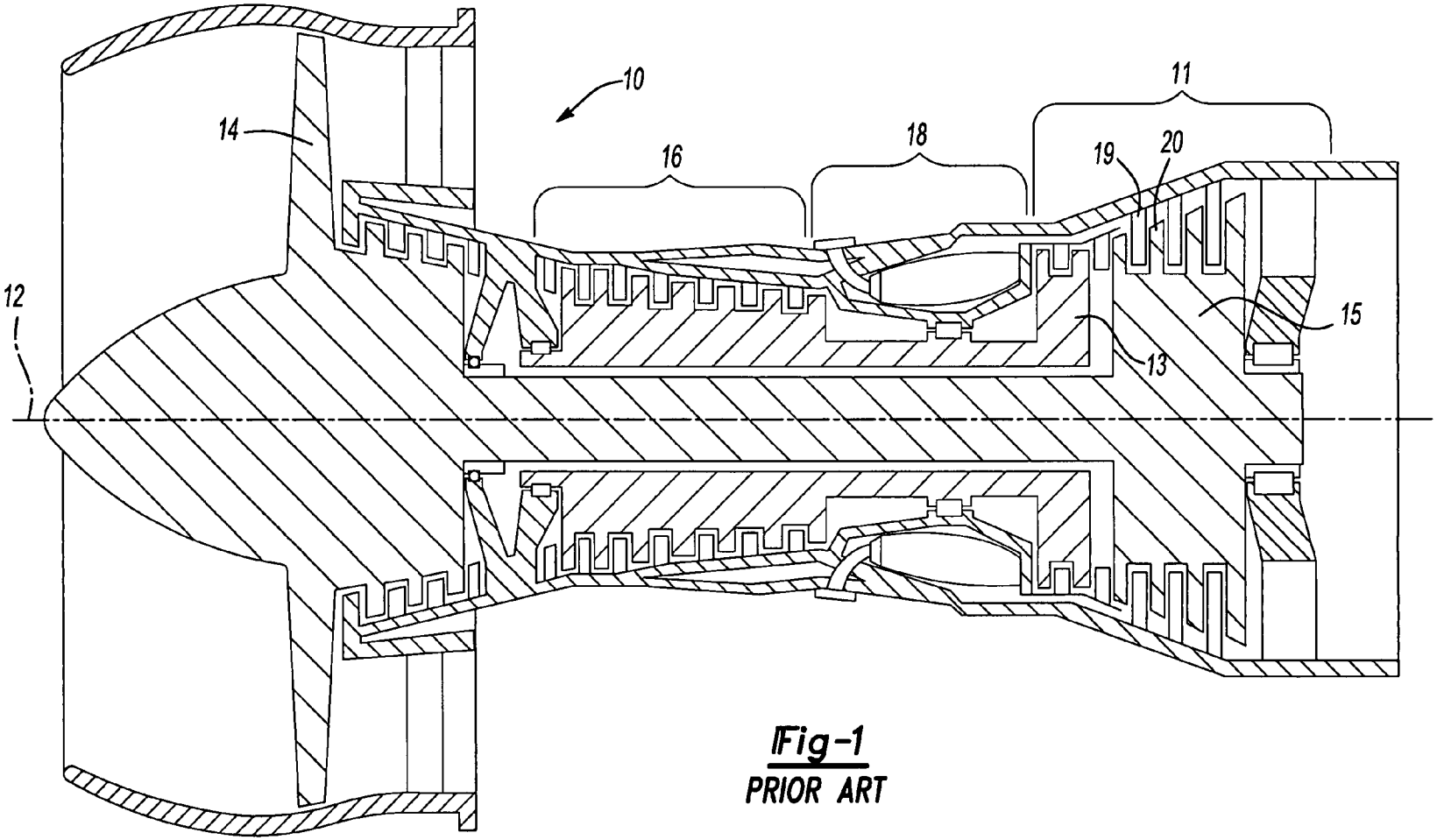
Fig-1 PRIOR ART
FIG. 1 is a schematic view of a typical gas turbine engine.

FIG. 1 shows a gas turbine engine 10, such as a gas turbine used for power generation or propulsion, circumferentially disposed about an engine centerline, or axial centerline axis 12. The engine 10 includes a fan 14, a compressor 16, a combustion section 18 and a turbine 11. As is well known in the art, air compressed in the compressor 16 is mixed with fuel which is burned in the combustion section 18 and expanded in turbine 11. The air compressed in the compressor and the fuel mixture expanded in the turbine 11 can both be referred to as a hot gas stream flow. The turbine 11 includes rotors 13 and 15 that, in response to the expansion, rotate, driving the compressor 16 and fan 14. The turbine 11 comprises alternating rows of rotary blades 20 and static airfoils or vanes 19. FIG. 1 is a somewhat schematic representation, for illustrative purposes only, and is not a limitation of the instant invention, that may be employed on gas turbines used for power generation and aircraft propulsion. The compressor 16 and fan 14 also include rotors and removable blades.

Figure 2:
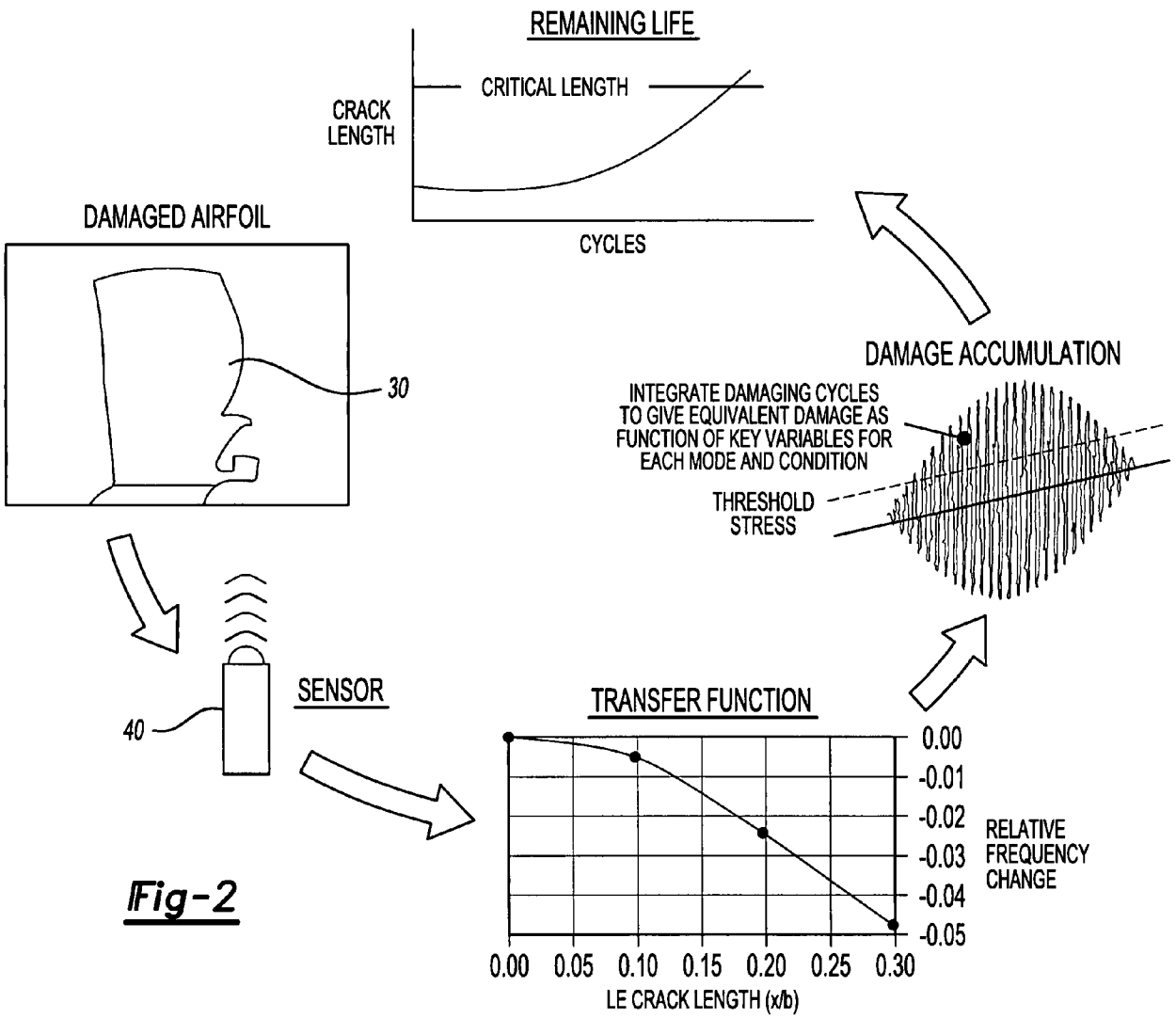
FIG. 2 schematically shows a method according to this invention.

FIG. 2 shows a method according to this invention in which remaining life for an airfoil such as turbine blade 30 is monitored. The invention extends to other blades, such as compressor, turbine or fan blades. A sensor 40 senses movement of blade 30. Conditions such as the time at which the leading edge of the airfoil passes a predetermined point, compared to an expected time, can be monitored. If the leading edge actually passes a predetermined point at a time different from the expected time an indication can be made that there is some problem with the particular airfoil. As is clear, the sensor 40 is positioned remotely from the turbine blade 30. The term "remotely," as used in this application, merely means that the sensor 40 is not mounted on the turbine blade 30, but rather is positioned such that the turbine blades move past the sensor 40.

The present invention has developed transfer functions which associate a relative frequency change, or other changes, with growing length of a crack in the airfoil. Different modes of monitoring the airfoil can be taken at different locations at the airfoil and can be utilized to predict the location and length of the crack. The transfer function such as shown in FIG. 2 can be determined experimentally and/or analytically, and are generally available to a worker of ordinary skill in this art. Over time, the damage to the airfoil will accumulate. Thus, a remaining life can be predicted given a particular crack length, and based upon the particular stresses on the airfoil in question.

Figure 3:
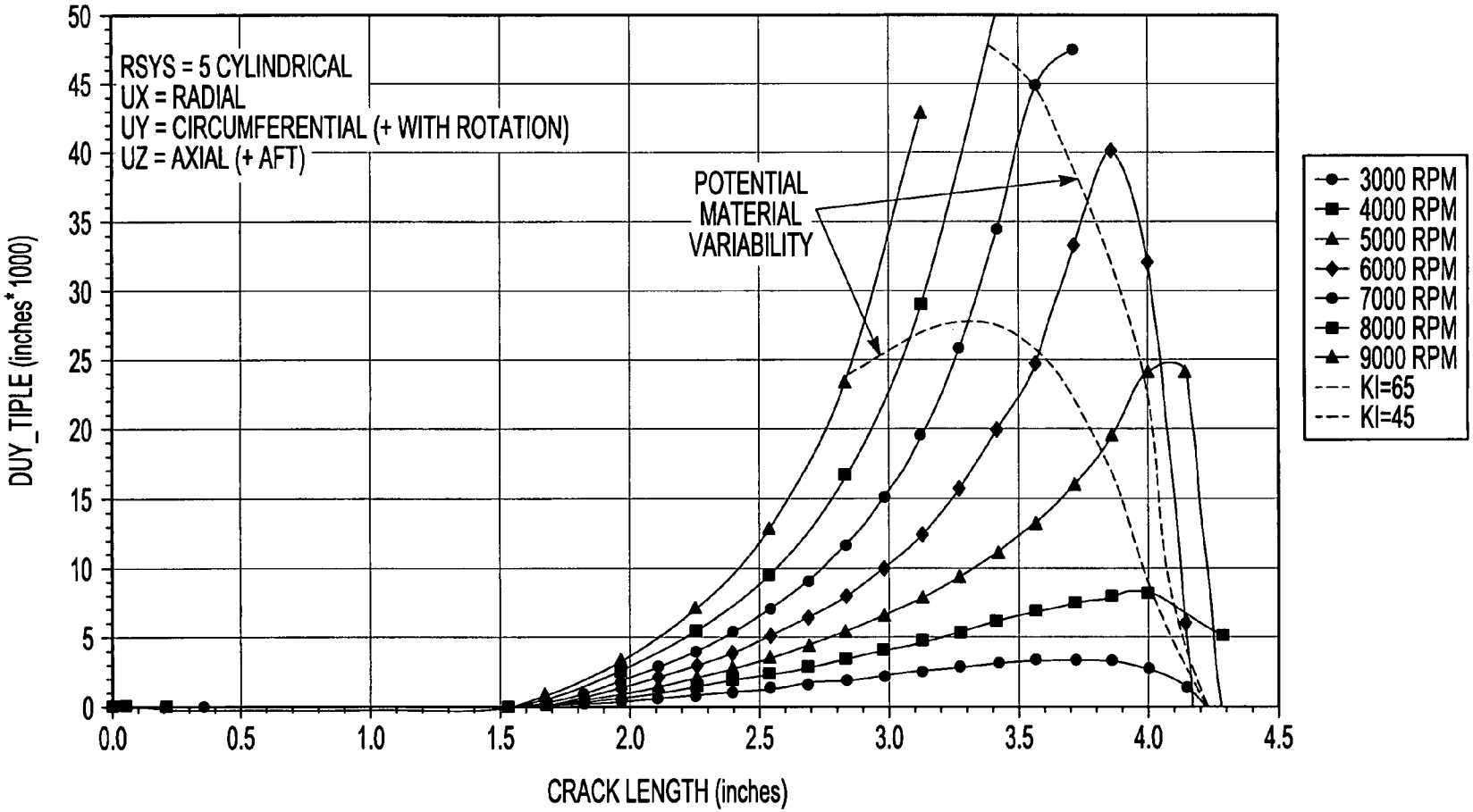
FIG. 3 shows a first table of information that allows the prediction of a crack of certain length in an airfoil.

FIG. 3 shows one embodiment of a table of information that associates a lean in the leading edge of the airfoil with a plurality of curves with different speeds of operation of the associated rotor. Now, a particular identified lean can be associated with the relative rotational speed, and in this manner a crack of certain length can be predicted. This information can be developed mathematically, and a worker of ordinary skill in the art would be able to develop the appropriate table. The Y axis is a measurement of blade deflection, or the "lean" of the leading edge measured in 1/1000 of an inch.

Figure 4:
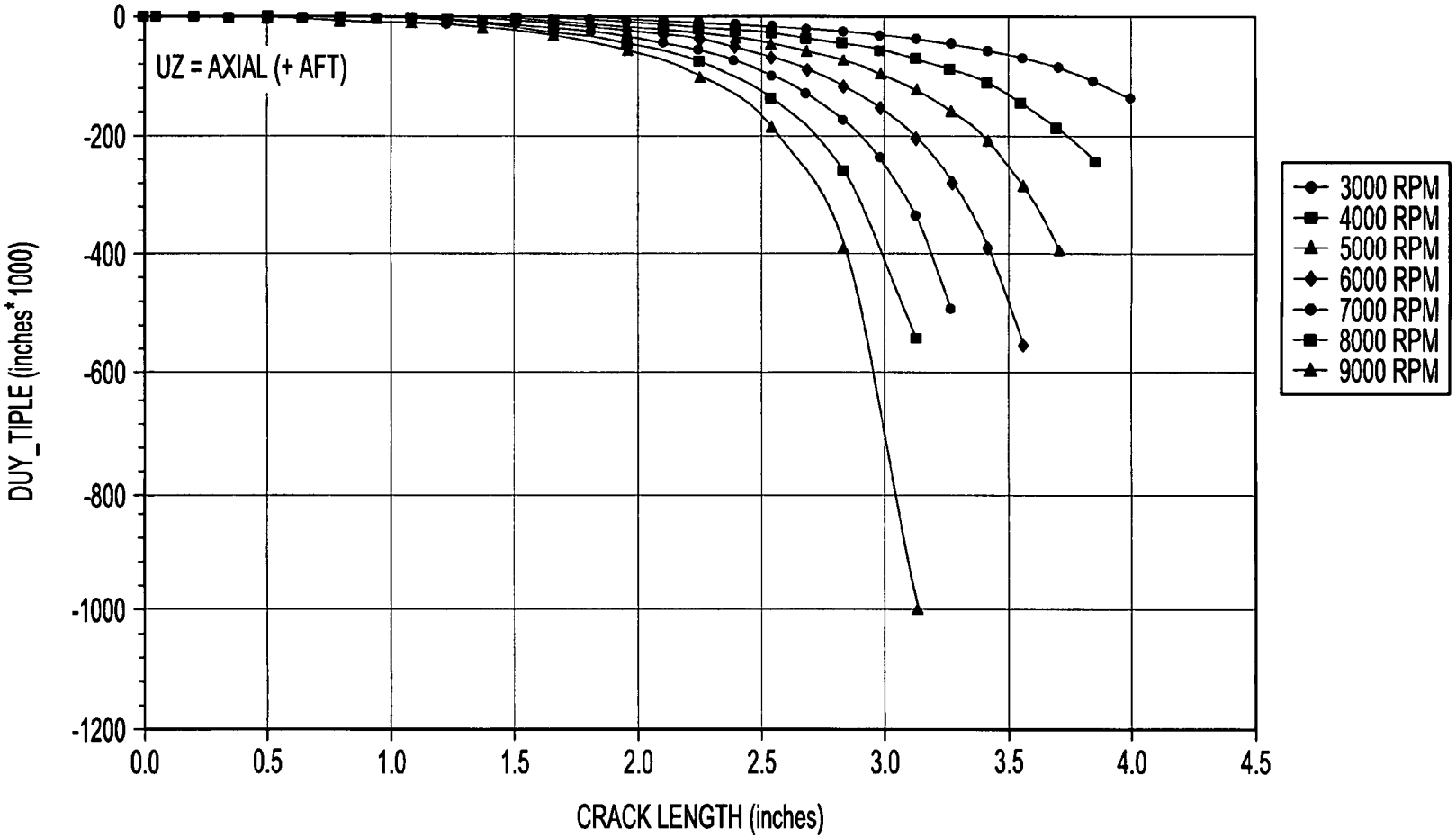
FIG. 4 shows an alternative table of information for predicting a crack when based upon a second system condition.

FIG. 4 shows another method of detecting a crack of certain length. Here, the tip of the leaning edge deflection is monitored. Again, the particular speed of operation is associated with a plurality of curves, and by finding the appropriate curve, and the appropriate amount of deflection, a prediction of a crack of certain length can be made. Again, the Y axis is measured as the leading edge deflection measured in 1/1000 of an inch.

Other deformations that can be measured include first bending mode, stiffwise bending mode, first torsion mode, chordwise bending mode, second leading edge bending mode, second bending mode, second torsion mode, chordwise second bending mode, and third trailing edge bending mode.

In general, each of these methods measure deformation of a position of a portion of the blade as the rotor and blade rotate. These deformations can then be associated with a crack length as mentioned above.

Figure 5:
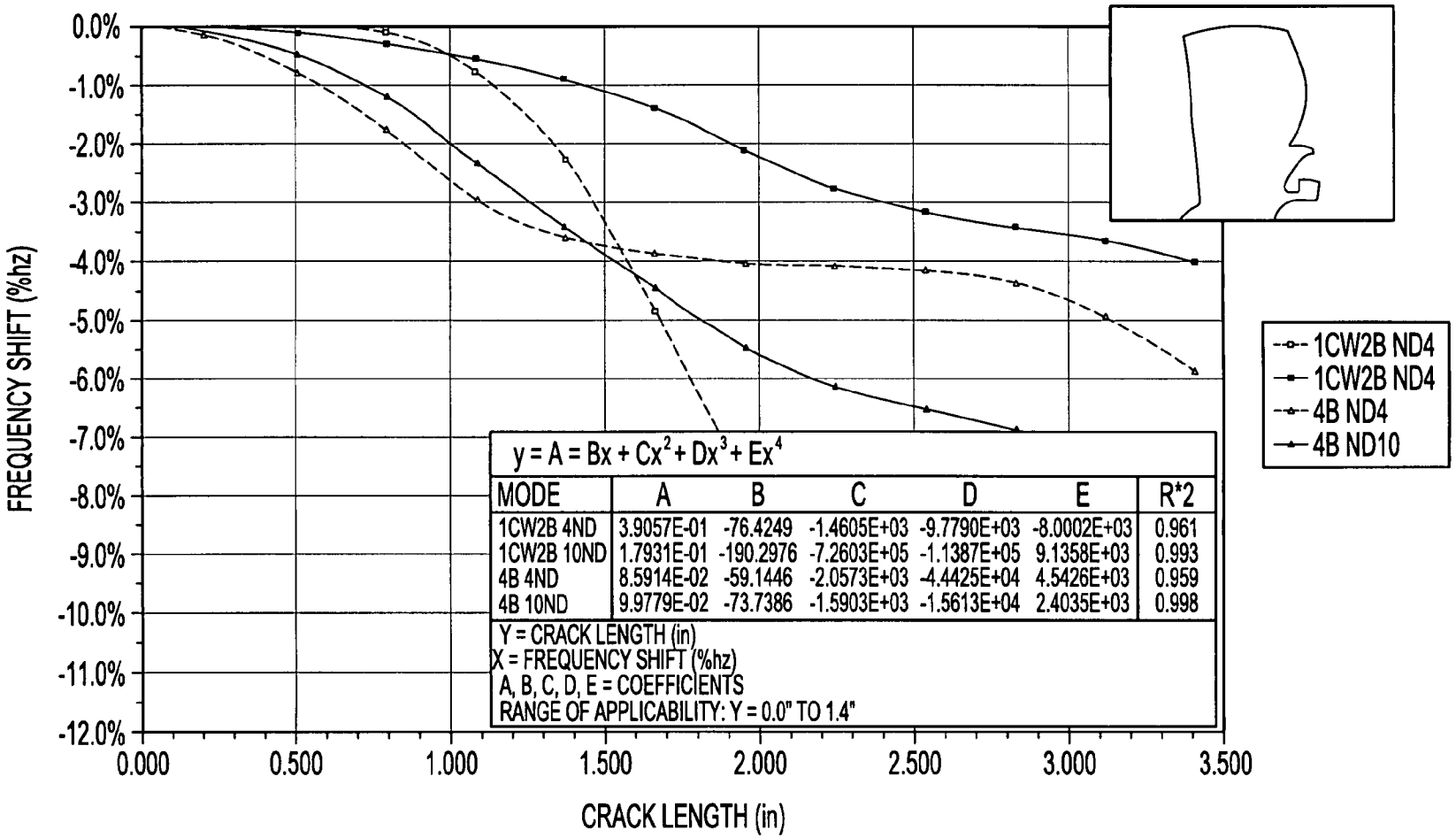
FIG. 5 shows yet another alternative table for predicting a crack of certain length.

FIG. 5 shows yet another embodiment, where model frequency shift is calculated and associated with a plurality of distinct measurements. Again, this can be utilized to predict a crack of certain length, as shown in the formula found in FIG. 5.

Figure 6:
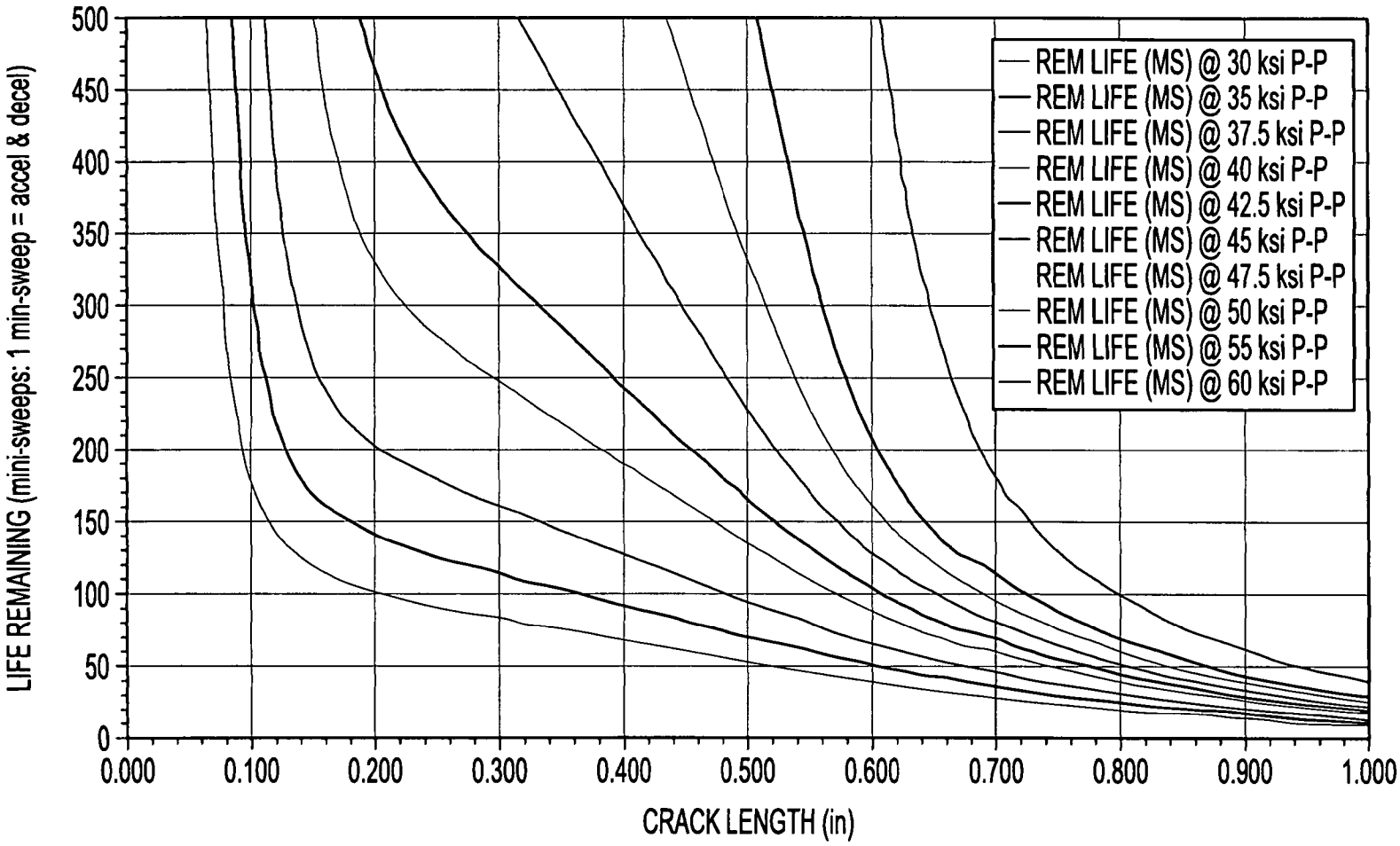
FIG. 6 shows a remaining life table based upon a crack length, and various stress levels which may be applied to the blade.

Once a crack of certain length has been detected, another family of curves can be used to associate various stress levels on the airfoil with a remaining life. Examples of such curves are shown in FIG. 6. Each curve represents the effect of different stress levels. In this figure, the remaining life is defined in "mini-sweeps" or times when the engine is accelerated and de-accelerated across a resonance frequency for the airfoil. Once the number of "mini-sweeps" remaining can be identified, a prediction can be made for the remaining useful life before failure of a particular airfoil. Essentially, the particular airfoil closest to failure would be a limitation on the amount of useful life for the entire engine and would suggest maintenance before the useful life has expired. Another measurement of useful life remaining would be cycles or missions. A computer associated with the sensors stores information with regard to each of the airfoils which are experiencing apparent cracks. The amount of damage which has been accumulated to that airfoil is stored in the computer, such that the computer has a running total of the amount of useful life remaining. As can be appreciated from this figure, at different stress levels, the useful life remaining changes. Thus, the computer must store not only the crack length and how often the particular engine has been operated, but also the operating conditions.

Further, with this invention and due to the various effects of different stress levels, it is apparent that by planning a particular flight schedule for an aircraft holding a particular jet engine, the number of flights remaining can be optimized. For example, in military applications there are high stress and low stress flights. An air to ground attack mission might be a relatively high stress flight in that it could involve frequent accelerations and decelerations. On the other hand, air cover under which an aircraft tends to remain high in the air at a relatively constant speed should be relatively low stress. A field commander might assign a particular aircraft to one of these flight schedules based upon an indicated remaining life indicated by this invention. This can lengthen the time between necessary maintenance.

Figure 7:
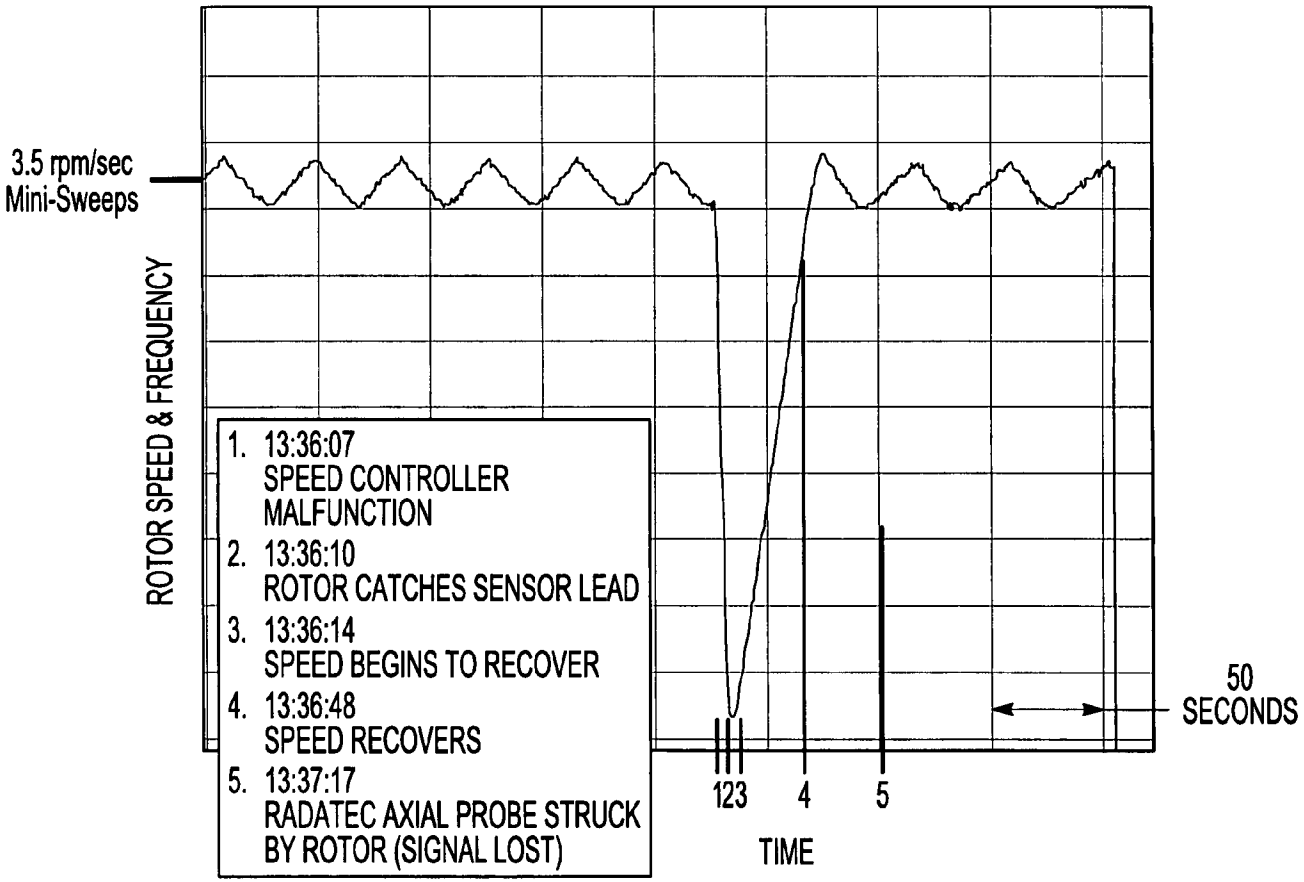
FIG. 7 shows a monitored stress condition that would be indicative of a failure in a gas turbine engine.

The information provided in this invention also can provide an indication of an apparent immediate failure. As an example, FIG. 7 illustrates a series of mini-sweeps as each blade passes by the sensor. At points 1-2-3, a dramatic drop occurs. This may be indicative of a blade that is bent so badly that it has contacted the sensor, etc. At any rate, such an indication might require immediate maintenance.

Figure 8:
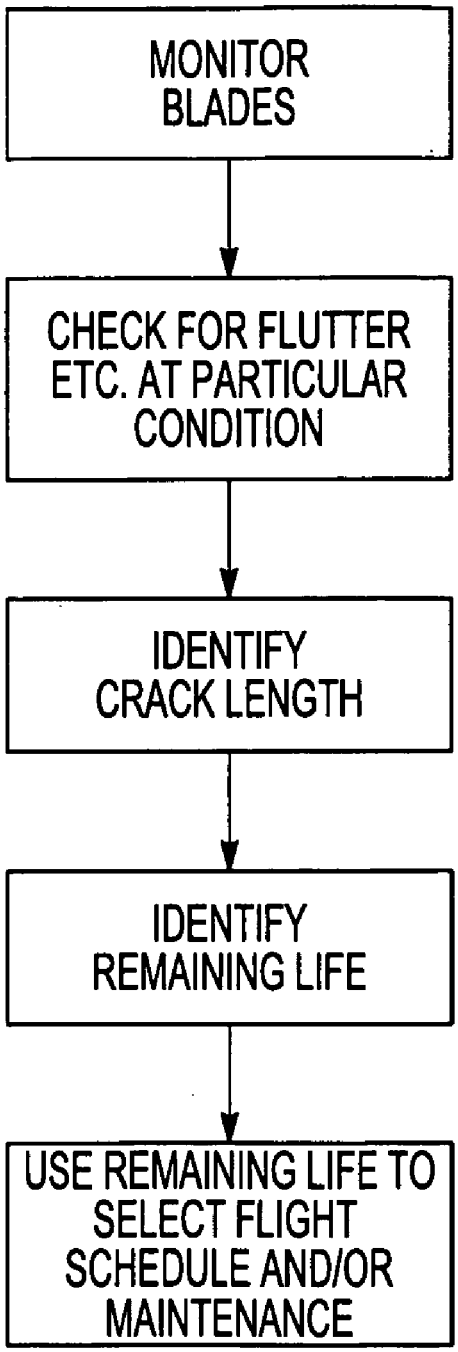
FIG. 8 is a flowchart of the present invention.

FIG. 8 is a basic flowchart of the present invention. The blade's rotation is monitored. A sensor and associated computer checks for flutter, etc. and determines that a particular blade has developed a crack. Once a crack has been detected, a crack length is determined. Once the crack length has been determined, a remaining life for the particular airfoil can be calculated. The computer then begins to store the actual conditions of operation for that airfoil such that a useful remaining life can be calculated in a continuous manner. The amount of remaining life can be utilized to schedule flights and maintenance, as mentioned above.

While the above embodiments of this invention are all disclosed utilizing a predicted crack length, other types of damage to a blade may also be utilized in connection with this invention.

While a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A turbine engine rotor section comprising:

a rotor carrying a plurality of blades; and a sensor positioned relative to said rotor, said sensor for sensing a condition of a plurality of said blades, as said blades move past said sensor, said sensor transmitting information to a computer, said information being monitored at said computer to predict damage in a blade within said rotor, and said predicted damage being utilized to predict an expected life of said blade, and said information including deformation of the blade as said rotor rotates.

2. The turbine engine rotor section of claim 1 wherein the predicted damage is a predicted length of a crack in said blade.

3. The turbine engine rotor section of claim 1 wherein the predicted damage is predicted utilizing a formula.

4. The turbine engine rotor section of claim 1 wherein said expected life of said blades is associated with an amount of continued operation of the blade.

5. The turbine engine rotor section of claim 4 wherein the amount of continued operation of the blades is expressed in terms of flights.

6. A method of operating a rotor for a turbine engine including the steps of:

(a) providing a rotor including a plurality of blades; and (b) sensing a condition of one of said blades, and said sensing including utilizing a sensor positioned off of said blades to sense the condition of a plurality of said blades as said plurality of said blades move past said sensor, and transmitting sensed information to be utilized to determine predicted damage in a blade within said rotor, said predicted damage being utilized to predict an expected life of said blade, and said information including deformation of a blade as said rotor rotates.

7. The method of claim 6 wherein the predicted damage is a predicted length of a crack in said blade.

8. The method of claim 6 further including that a rotational speed of the rotor is utilized to predict an expected life of said blade.

* * * * *